US006244150B1

(12) United States Patent
Holcomb et al.

(10) Patent No.: US 6,244,150 B1
(45) **Date of Patent: *Jun. 12, 2001**

(54) CHEESE SLICER

(75) Inventors: David Holcomb; Bradley Burton Larsen, both of Seattle, WA (US)

(73) Assignee: Chef'n Corporation, Seattle, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/800,115

(22) Filed: Feb. 13, 1997

Related U.S. Application Data

(63) Continuation of application No. 08/307,876, filed on Sep. 16, 1994, now abandoned.

(51) Int. Cl.[7] ..... B26D 1/06

(52) U.S. Cl. ..... 83/613; 83/697; 83/932

(58) Field of Search ..... 83/564, 613, 651.1, 83/171, 932, 468.7, 468.6, 468, 467.1, 762, 761, 697, 856, 136; 30/357, 339, 315, 305, 169, 280, 296.1

(56) References Cited

U.S. PATENT DOCUMENTS

| | | | | |
|---|---|---|---|---|
| 519,251 | * | 5/1894 | Feneran et al. | 30/315 |
| 751,695 | * | 2/1904 | Smithwick | 83/697 |
| 940,308 | * | 11/1909 | Fesemeyer . | |
| 944,087 | | 12/1909 | Gloekler et al. . | |
| 954,498 | | 4/1910 | Bieder . | |
| 1,130,281 | * | 3/1915 | Hay | 30/315 |
| 1,457,374 | * | 6/1923 | Lazarus | 30/305 |
| 1,489,419 | * | 4/1924 | Beechlyn | 30/357 |
| 1,546,035 | * | 7/1925 | Sillers | 30/305 |
| 1,623,288 | * | 4/1927 | Topinka et al. | 83/136 |
| 1,952,136 | * | 3/1934 | Mueller | 83/136 |
| 2,178,267 | | 10/1939 | Potstada | 30/115 |
| 2,309,814 | | 2/1943 | Youngberg | 30/115 |
| 2,566,112 | * | 8/1951 | Barnard | 30/357 |
| 2,570,671 | | 10/1951 | Hartman | 30/286 |
| 2,580,864 | | 1/1952 | Upright | 31/20 |
| 2,803,876 | * | 8/1957 | Nelson | 30/357 X |
| 2,814,875 | * | 12/1957 | Seals | 30/315 |
| 2,836,212 | | 5/1958 | Shaw | 146/160 |
| 2,858,610 | | 11/1958 | Glutting | 30/279 |
| 2,958,943 | * | 11/1960 | Koe | 30/115 X |
| 3,035,344 | * | 5/1962 | Brown | 30/115 X |
| 3,078,927 | * | 2/1963 | Wetzel | 30/315 X |
| 3,824,885 | * | 7/1974 | Marshall et al. . | |
| 4,248,660 | * | 2/1981 | Johnson | 30/357 |
| 4,513,501 | * | 4/1985 | Lee | 30/115 |
| 4,959,905 | | 10/1990 | Ghislain | 30/298.4 |
| 5,309,805 | * | 5/1994 | Mezger et al. | 30/169 X |
| 5,404,777 | * | 4/1995 | Skaar et al. . | |
| 5,771,766 | * | 6/1998 | Vedders et al. . | |

FOREIGN PATENT DOCUMENTS

| | | | | |
|---|---|---|---|---|
| 7859 | * | 2/1894 | (CH) | 30/115 |
| 77681 | * | 3/1894 | (DE) | 30/115 |
| 226017 | | 9/1909 | (DE) . | |
| 495205 | | 3/1930 | (DE) . | |
| 1424675 | | 2/1965 | (FR) . | |
| 277055 | | 2/1927 | (GB) . | |
| 45742 | | 5/1939 | (NL) . | |

* cited by examiner

*Primary Examiner*—Kenneth E. Peterson
(74) *Attorney, Agent, or Firm*—Seed IP Law Group PLLC

(57) ABSTRACT

A cheese slicer having a flat base and a blade holder releasably pivotally secured to the base for moving from a locked upright cheese slicing position to a lowered storing position. A unique wide, flat blade slidably carried in the blade holder and having an upper end with a large handle and a lower end. The lower end having a downwardly and rearwardly sloping separating surface terminating in a downwardly protruding blunt slicing edge.

4 Claims, 3 Drawing Sheets

CHEESE SLICER

This application is a continuation of U.S. patent application Ser. No. 08/307,876, filed Sep. 16, 1994, now abandoned.

TECHNICAL FIELD

This invention relates generally to slicers for slicing soft food products, such as cheese, butter, paté and the like.

BACKGROUND OF THE INVENTION

There is a need for a cheese slicer of the type capable of cutting smoothly a slice of cheese from a block of cheese. Heretofore cheese cutters have used knife blades or wires. An example of a wire cheese slicer is shown in U.S. Pat. No. 4,960,024. An example of a cutting blade is shown in U.S. Pat. No. 2,570,671.

These cheese slicers, however, have been somewhat awkward to handle or create storage problems.

SUMMARY OF THE INVENTION

It is an object of this invention to provide an improved cheese slicer having a wide, flat blade and a blade holder which can be pivoted from an upright slicing position to a folded collapsible position for storage.

It is another object of this invention to provide a cheese slicer where the slicing blade is easily removed for cleaning.

Still another object of this invention is to provide a cheese slicing blade having a wide, flat body with a lower end which smoothly separates the slice of cheese from the block of cheese.

Basically, these objects are achieved by having a flat base with a pivotally mounted cheese slicing blade holder on the base. The blade holder is provided with opposed slots which receive a large flat, wide slicing blade. Detents hold the blade holder in its upright slicing position. The blade has an upper end with a large flat handle and a lower end with a downwardly and rearwardly sloping separating surface. The separating surface terminates downwardly along a plane parallel to the flat, wide slicing blade and terminates into a blunt edge of a shape roughly equivalent to a cheese slicing wire.

With this invention, the slicing of cheese is done very quickly with smooth separation of the slices from the block of cheese. For storage, the blade holder folds down to a compact position taking much less space that in its upright position.

DETAILED DESCRIPTION OF THE EMBODIMENTS

Figure 1:
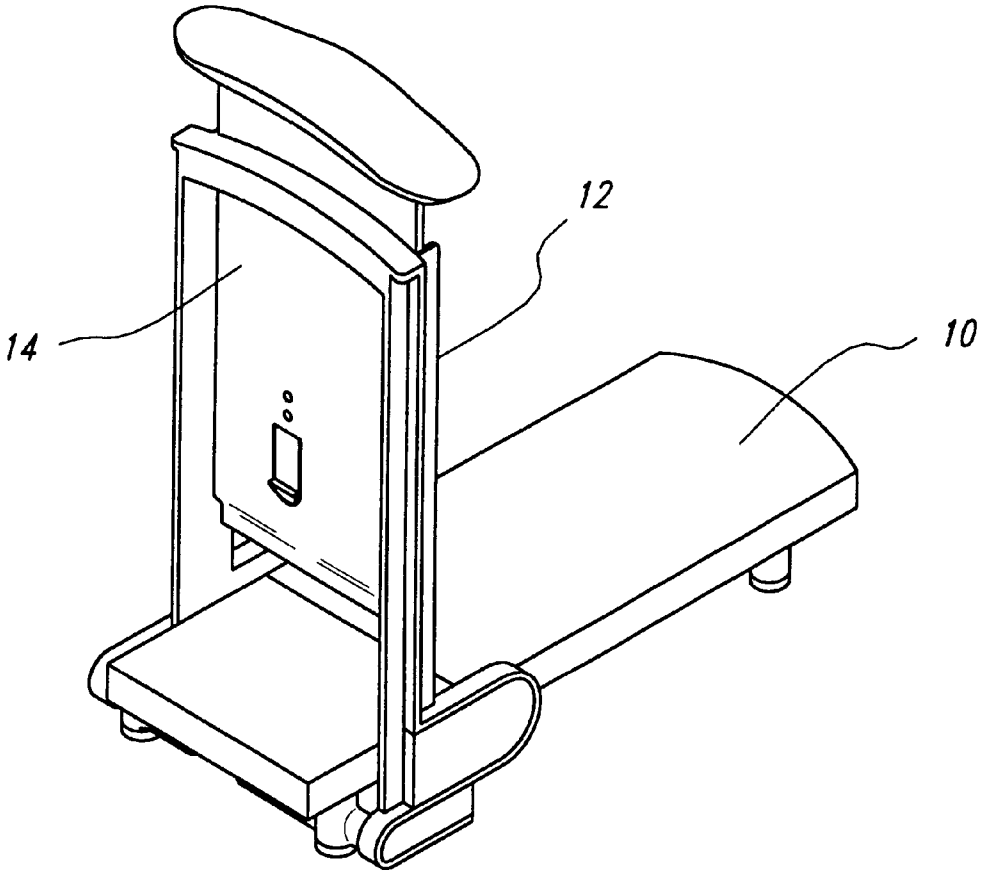
FIG. 1 is an isometric of the cheese slicer with the blade holder in an upright position.

As best shown in FIG. 1, the cheese slicer has a flat base 10, an upright blade holder 12, a wide, flat blade 14 slidably secured in the blade holder.

Figure 3:
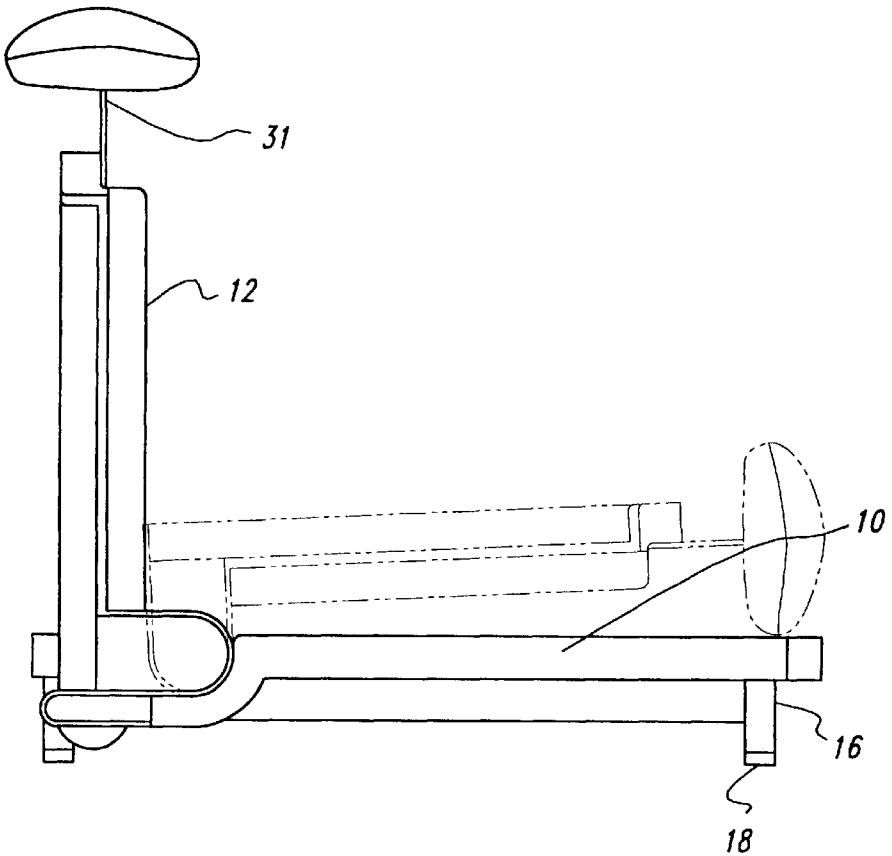
FIG. 3 is a side elevation of the cheese slicer.

The flat base 10 is a rigid plastic member having support legs 16. Rubber cushioning pads 18 are connected to each of the four support legs. The blade holder 12 is pivotally mounted to the forward end of the base by pivot pins 20. Thus, the blade holder can move from the upright position shown in FIG. 3 to the phantom line storage position shown in FIG. 3.

Figure 5:
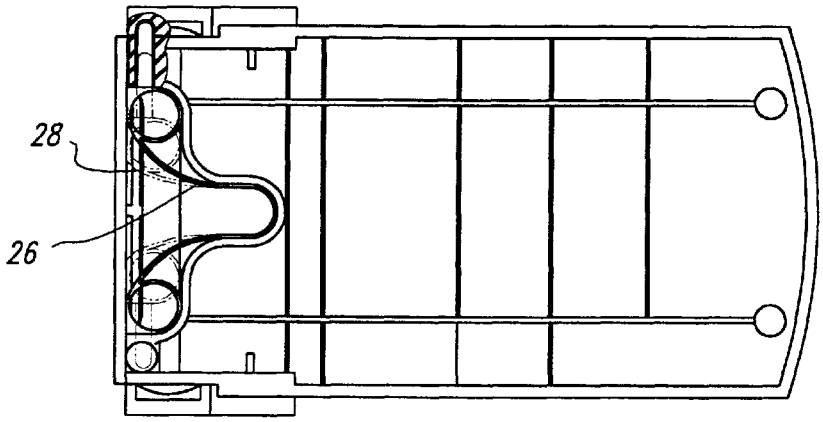
FIG. 5 is a bottom view of the cheese slicer.

The blade holder is held in its upright position by spring biased detent pins 22 which are received in recesses 24. As best shown in FIG. 5 the pins are pushed into the recesses by a spring 26 having finger grips 28. The lower ends of the blade holder are also provided with ramps 30 which slide over the detent pins compressing them until the pins are beyond the ramps and are pushed outwardly into the recesses 24 by the spring 26 Thus, the blade holder is automatically locked into its upright position when it is raised. To release the pins, the finger grips 28 are compressed toward one another which withdraws the detent pins from the recesses allowing the blade holder to be moved to the storage folded position.

Figure 2:
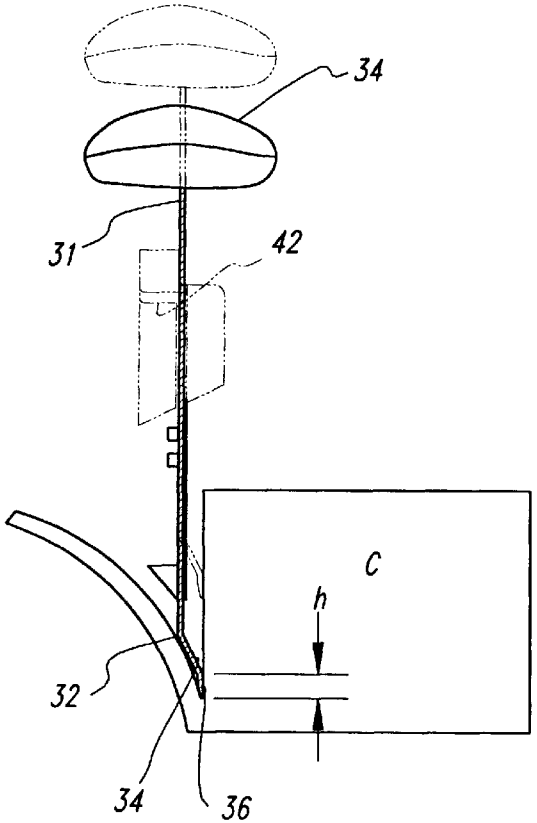
FIG. 2 is a schematic illustration showing the blade separating a slice of cheese from a block of cheese.
Figure 4:
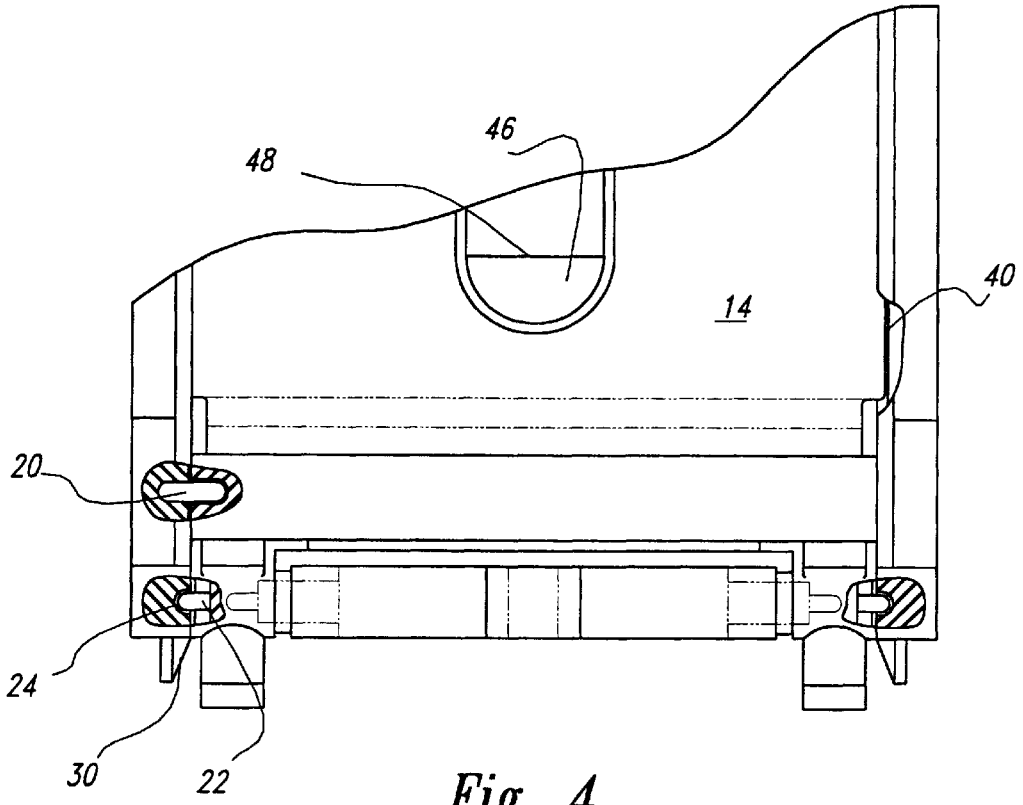
FIG. 4 is a fragmentary front elevation of the cheese slicer with parts broken away for clarity.

As best shown in FIGS. 2 and 4, the slicing blade 14 is a large wide, thin flat body having an upper end 31 and a lower end 32 and forward and rear sides. The upper end has a large flat smooth handle 34 attached thereto so that the palm of the hand can be used for pushing the slicing blade through the cheese C.

The lower end of the slicing blade is joined to a rearwardly offset slicing surface with a rearwardly, downwardly sloped separating surface 34 that terminates in a lower slicing terminal edge 36. The thickness of the blade at the slicing edge is about 0.80 mm and is blunt like a cheese slicing wire rather than provided with a sharp edge. The height "h" is kept to a minimum and is approximately 3/16 of an inch. This reduces the friction against the cheese during cutting making movement of the slicing blade through the cheese easier. The sloping surface allows the front upper edge of the sloping surface where it bends into the cutting blade to gently push a slice of cheese away, allowing for easy separation of the cheese and again minimizing friction between the cutting blade and the block of cheese.

The slicing blade has opposed guide areas that are guided in the blade holder in a pair of opposed grooves 40. The upper end of the blade holder has a cross bar 42 on the forward side of the holder only. The blade is provided with a central spring biased pawl 46 that can be flexed rearwardly. The pawl has an upper ledge 48 which will engage the support bar 42 when the handle is raised to slice another slice of cheese. To remove the blade for cleaning, however, the pawl can be pushed rearwardly until the ledge 48 is clear of the support bar 42 and the blade can be slid free of the blade holder.

In operation the blade holder is swung up to its upright position with the detent pins automatically being compressed by the ramps and then falling into the recesses for holding the blade holder securely in the upright position. The blade is raised and the block of cheese placed on the base and slid forward one slice thickness. The operator then places a hand on the handle pushing the blade through the forward end of the block of cheese with the separating edge slicing the cheese and separating it from the block of cheese. The lower cutting edge 36 of the cheese jogs down from the separating surface and is approximately parallel to the plane of the slicing blade and provides only a minimum height for low friction engagement with the block of cheese making the slicing of the cheese very easy for the operator. If the operator wishes to wash the blade, it is only necessary to depress the pawl 46 and lift the blade free of the blade holder. Furthermore, for storage, it is only necessary to compress the spring 26 by placing the finger and thumb in the finger grips 28 and retracting the detent pins from their recesses. This allows the blade holder to pivot downwardly and rest smoothly against the base for a minimum storage dimension.

As is apparent, the invention is capable of modification and those skilled in the art will understand the principles from the disclosure herein. Accordingly, the invention is not to be limited to the specific embodiment illustrated in the drawings.

What is claimed is:

1. A device for slicing a food product, said device comprising a base for supporting a block of said food product;

a blade holder having an upright position at one end of said base, said blade holder having opposed parallel grooves; and a unitary blade of uniform thickness, said blade comprising a single flat upper major portion having parallel lateral edges slidingly retained in said grooves so that the blade can move through a cutting stroke between said upper and lower positions, a lower minor portion substantially parallel to said upper major portion, said lower minor portion being offset from said upper major portion in a direction toward a portion of the base upon which the block of food product is intended to rest, and terminating at a cutting edge, the motion of the cutting edge through the cutting stroke defining a cutting plane and no other part of the blade ever being in said cutting plane, and an intermediate portion extending at an angle between said lower minor portion and said upper major portion, whereby said upper major portion is kept out of contact with said food product, said minor portion cuts the food product, and the intermediate portion deflects cut slices away from the base.

2. The device of claim 1, further comprising a handle extending along an upper edge of said upper major portion whereby one can drive the blade from its upper position to its lower position by pressing on the handle.

3. The device of claim 1, wherein the cutting edge of the blade is blunt.

4. The device of claim 1, wherein the cutting edge of the blade is a straight edge.

* * * * *